US007040916B2

(12) United States Patent
Schmidt et al.

(10) Patent No.: US 7,040,916 B2
(45) Date of Patent: May 9, 2006

(54) PLUG HOUSING WITH IMPROVED CABLE SEALING

(75) Inventors: Martin Schmidt, Luebbecke (DE); Nicole Kruke, Luebbecke (DE); Frank Quast, Bielefeld (DE); Uwe Sundermeier, Espelkamp (DE)

(73) Assignee: Harting Electric GmbH & Co. KG, (DE)

( * ) Notice: Subject to any disclaimer, the term of this patent is extended or adjusted under 35 U.S.C. 154(b) by 0 days.

(21) Appl. No.: 10/963,364

(22) Filed: Oct. 12, 2004

(65) Prior Publication Data

US 2005/0079749 A1 Apr. 14, 2005

(30) Foreign Application Priority Data

Oct. 14, 2003 (DE) ..... 103 47 696

(51) Int. Cl.
*H01R 13/58* (2006.01)

(52) U.S. Cl. ..... 439/460; 439/455; 439/465; 439/687; 439/731; 439/906

(58) Field of Classification Search ..... 439/460, 439/465, 467, 455, 687, 731, 906

See application file for complete search history.

(56) References Cited

U.S. PATENT DOCUMENTS

| | | | | |
|---|---|---|---|---|
| 3,781,766 | A * | 12/1973 | Teagno et al. | 439/297 |
| 4,108,527 | A | 8/1978 | Douty et al. | 439/465 |
| 4,272,148 | A * | 6/1981 | Knack, Jr. | 439/455 |
| 4,963,104 | A | 10/1990 | Dickie | 439/460 |
| 5,518,415 | A * | 5/1996 | Sano | 439/204 |
| 5,596,176 | A * | 1/1997 | Everitt | 174/151 |
| 6,071,145 | A * | 6/2000 | Toly | 439/485 |
| 6,083,031 | A * | 7/2000 | Kuo | 439/362 |

FOREIGN PATENT DOCUMENTS

| | | |
|---|---|---|
| DE | 299 23 811 | 10/1999 |
| EP | 0 442 367 | 2/1991 |
| EP | 0901190 | 3/1999 |
| GB | 2 377 821 | 1/2003 |

* cited by examiner

*Primary Examiner*—Tho D. Ta
(74) *Attorney, Agent, or Firm*—Hayes Soloway P.C.

(57) ABSTRACT

A plug housing (5) includes a first housing part (10) and a second housing part (12) which rest at each other along a parting line (14), and a cable passage (9) for a cable (8) from an interior space of the plug housing (5) towards outside. The parting line (14) extends in the region of the cable passage (9). The plug housing further includes a sealing insert (34) arranged in the cable passage (9). The sealing insert (34) is provided with a slot (44) so that it can be slipped on a preassembled cable (8). The sealing insert (34) is also arranged such that the slot (44) has an offset with respect to the parting line (14).

18 Claims, 6 Drawing Sheets

PLUG HOUSING WITH IMPROVED CABLE SEALING

TECHNICAL FIELD

The invention relates to a plug housing which is particularly suited for receiving a preassembled cable.

BACKGROUND OF THE INVENTION

A preassembled cable is distinguished in that its wires are already connected with contacts, which for their part may already be arranged in an insulating body. The preassembled cables are for instance used to carry out wiring of electrical devices on the scene, which cables have to be laid in different directions with respect to the devices depending on the spatial conditions. On connecting the cable, the insulating body including the contacts is placed in a plug housing which is adapted to the spatial conditions at the place concerned, for instance with regard to the cable outlet direction. Due to the contacts and the insulating body being already attached, the problem with preassembled conductors is that the cable can not be inserted in axial direction into an e.g. closed housing through a screwed cable joint or through a cable sealing. Instead, it is required to use an at least two-part housing whose parting line is arranged such that in the open condition the cable can be laid between the two housing parts. Similar problems arise with respect to the sealing of the cable in the region of the cable passage through the housing. It is not possible to use a closed sealing ring, because it can not be slipped over the insulating body. Instead of this either a slotted or a multipart sealing ring has to be employed.

The disadvantage with multipart housings and multipart or slotted sealing rings is that a reliable sealing against the ingress of dirt is only possible with special expenditure, in particular if higher IP safety classes are to be achieved.

Accordingly, it is the object of the invention to provide a plug housing that can be equipped with a preassembled cable and can meet high requirements regarding tightness with low expenditure.

SUMMARY OF THE INVENTION

A plug housing is proposed which includes a first housing part and a second housing part which rest at each other along a parting line, and a cable passage for a cable from an interior space of the plug housing towards outside. The parting line extends in the region of the cable passage. The plug housing further includes a sealing insert arranged in the cable passage. The sealing insert is provided with a slot so that it can be slipped on a preformed cable. The sealing insert is also arranged such that the slot has an offset with respect to the parting line. By such design it is ensured that the sealing insert with a cable arranged therein can be placed in one of the two housing parts where it is fixedly retained by friction. Subsequently the second housing part can be placed on and screwed tight, whereby the sealing insert is compressed such that it seals off well.

Advantageous designs of the invention will be apparent from the sub-claims.

DETAILED DESCRIPTION OF THE PREFERRED EMBODIMENT

Figure 1:
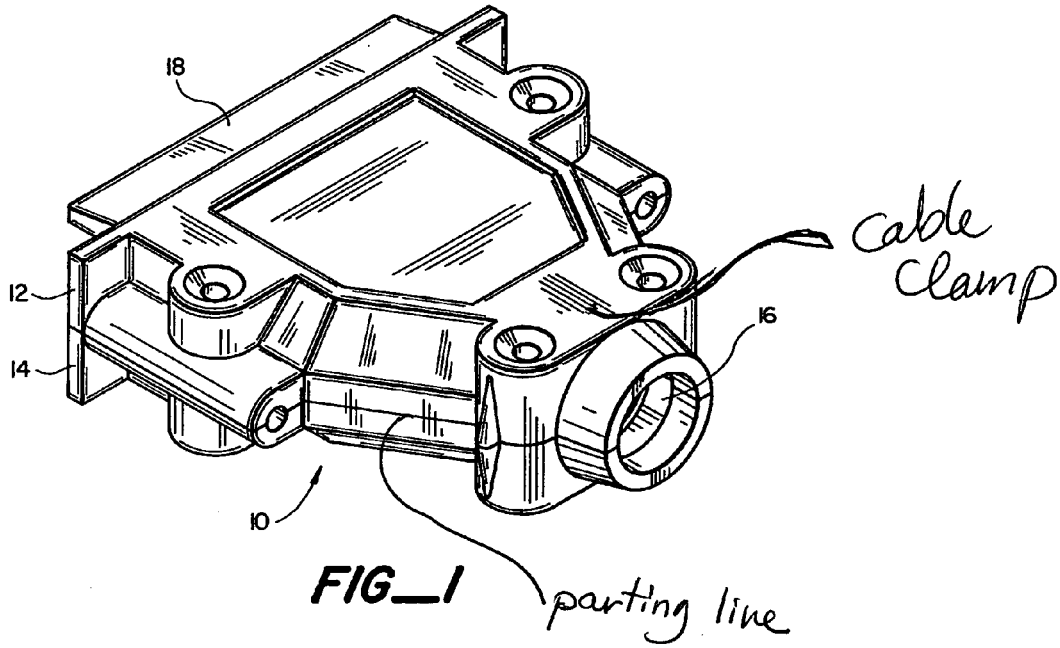
FIG. 1 shows in a perspective view a plug housing according to the invention with an attached cable.

FIG. 1 shows a plug connector consisting of a plug housing 5 in which several plug contacts are received that are concealed here by an insulating body 7 surrounding them. Leading into the plug housing 5 is a cable 8 whose wires are connected with the plug contacts in the insulating body 7. The cable 8 is guided through a cable passage 9 in whose region a sealing is established which will be explained below.

Figure 2:
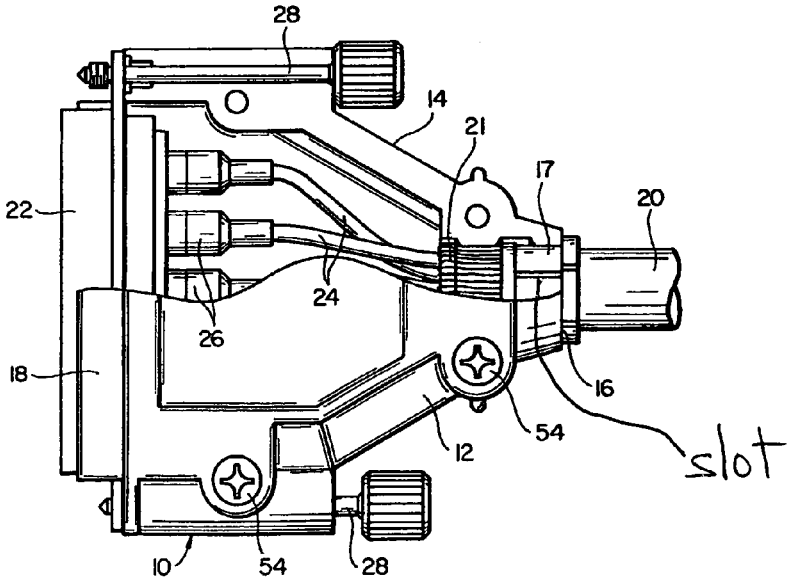
FIG. 2 shows the plug housing of FIG. 1 in an exploded view.
Figure 3:
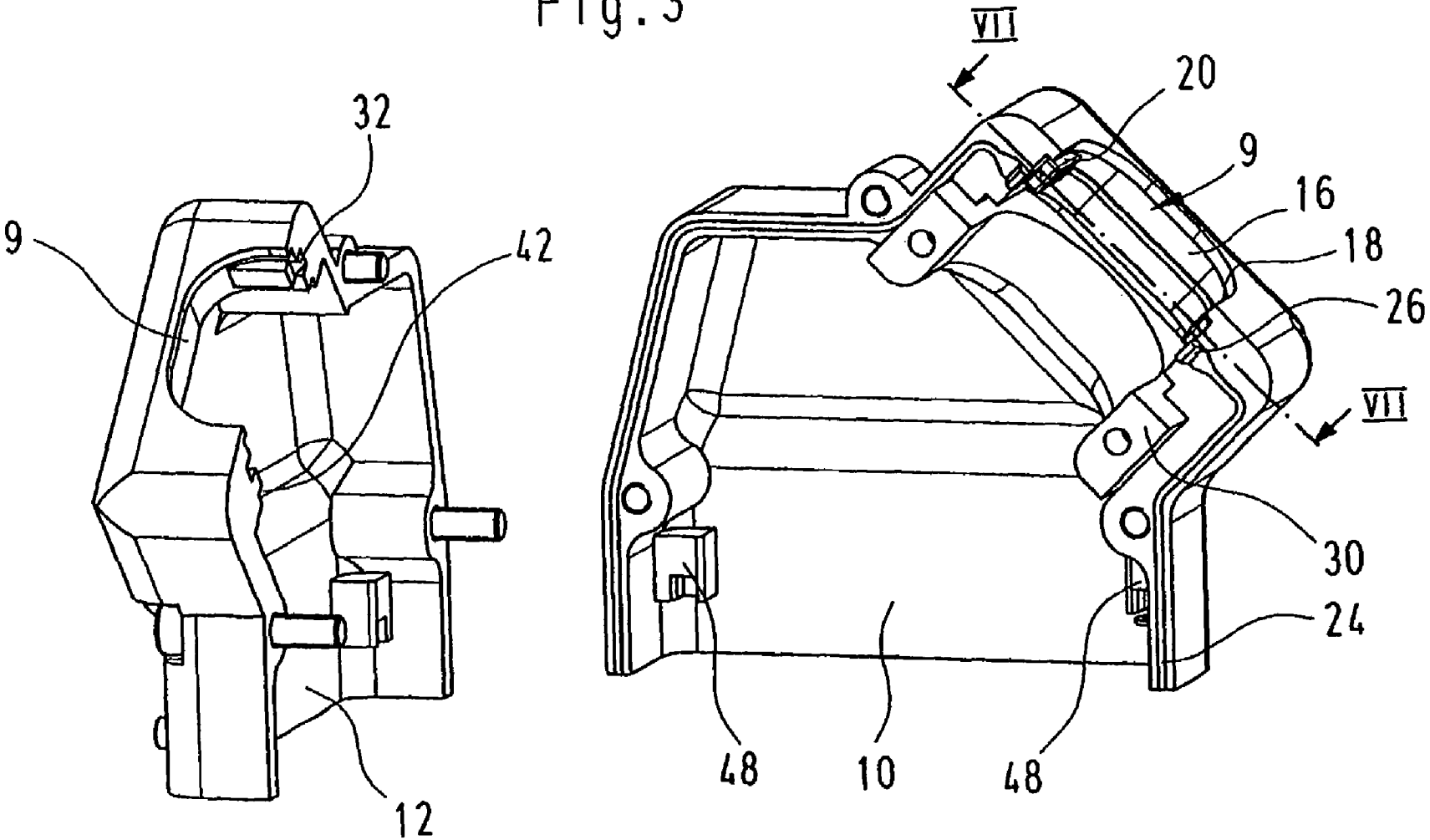
FIG. 3 shows in a view corresponding to that of FIG. 2 the two housing parts of the plug housing of FIG. 1.
Figure 7:
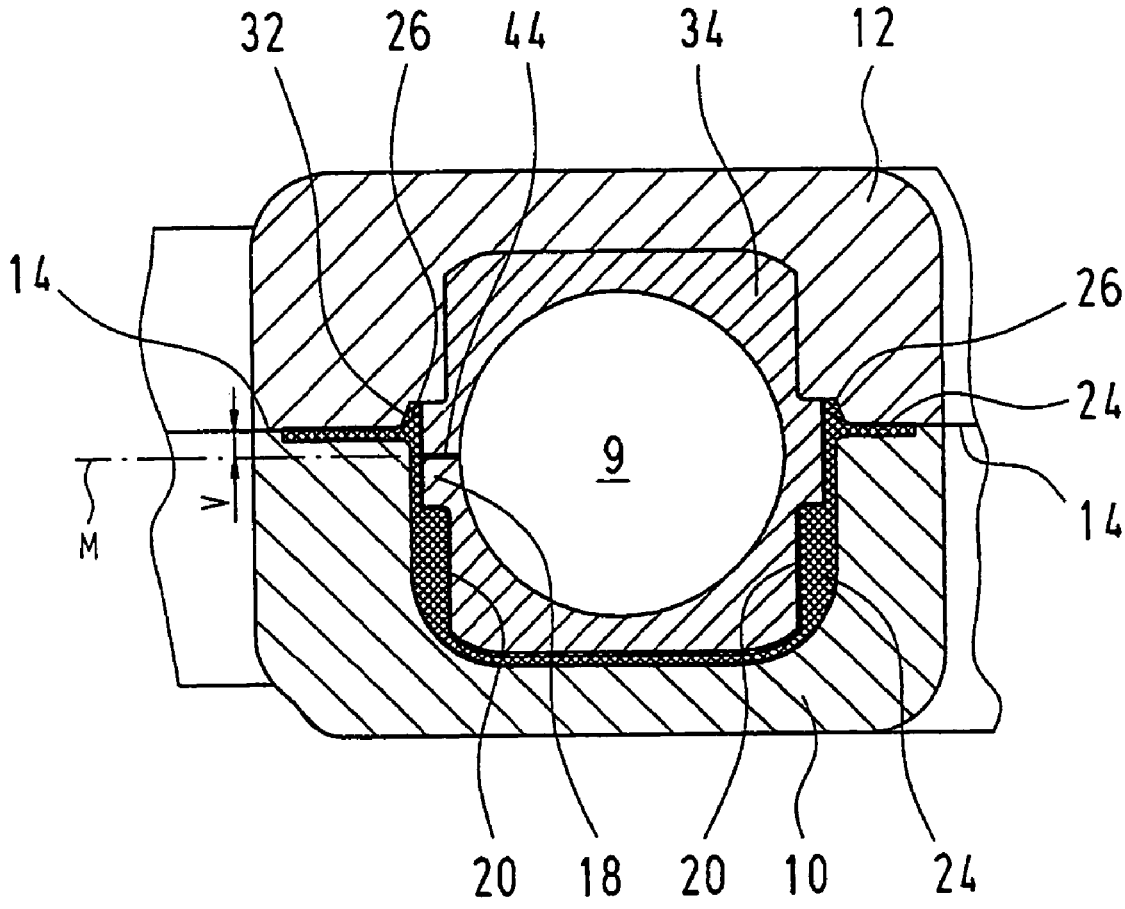
FIG. 7 shows schematically a section through the closed plug housing along plane VII—VII of FIG. 3.
Figure 1:
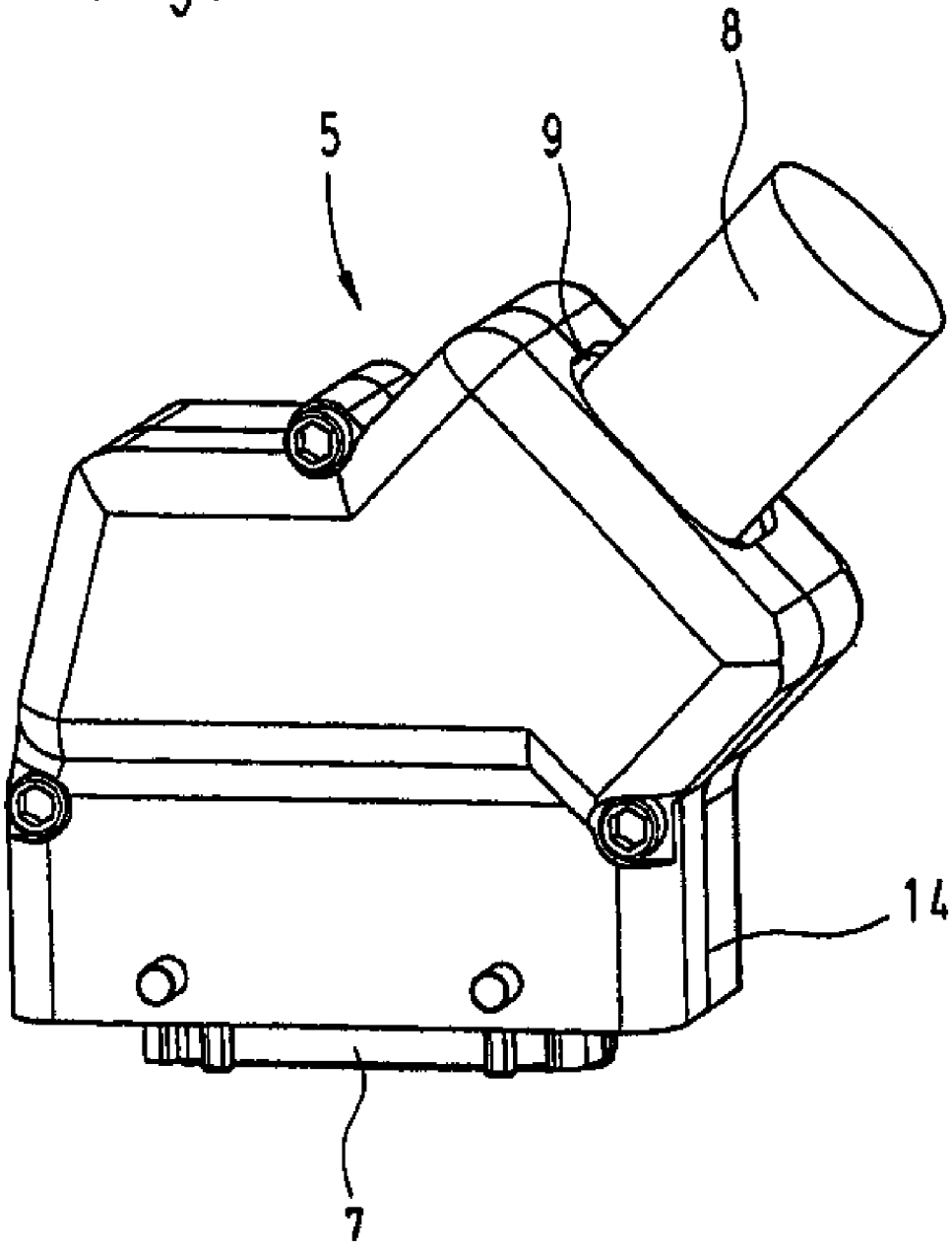
Figure 2:
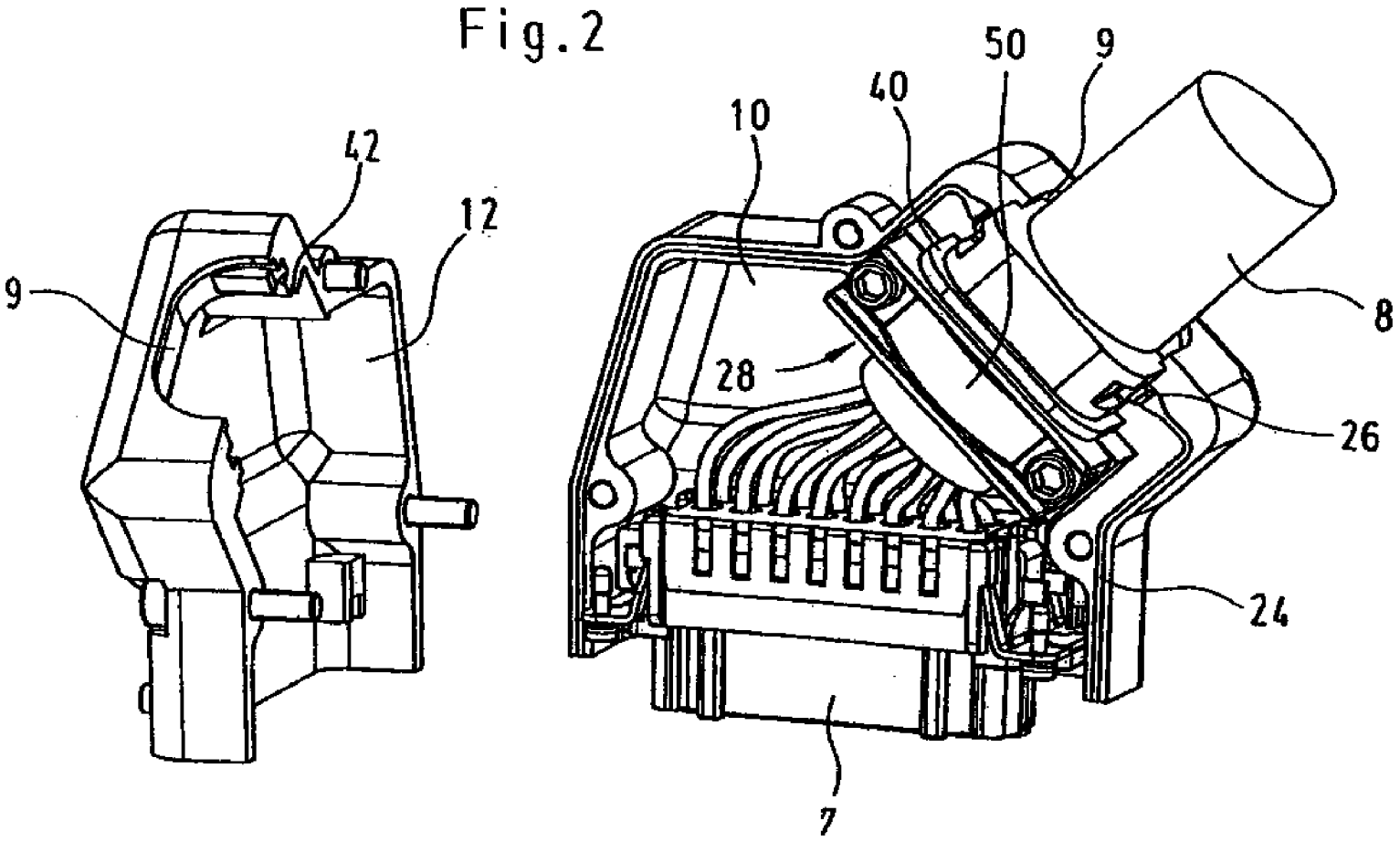

The cable 8 is a preassembled cable whose wires are already fixedly connected with the plug contacts in the insulating body 7. It follows from this that the plug housing 5 has to be opened, because otherwise it would not be possible to lay the cable together with the insulating body 7 into the plug housing. As can be seen in FIG. 2, the plug housing consists to this end of a first housing part 10 and a second housing part 12 which are designed to rest at each other along a surrounding parting line 14 (see also FIG. 7). As can be seen in particular in FIG. 7, the parting line 14 is slightly offset to one side with respect to a center plane M of the housing. This offset V amounts to not more than 10% of the entire maximum width of the plug housing.

Figure 4:
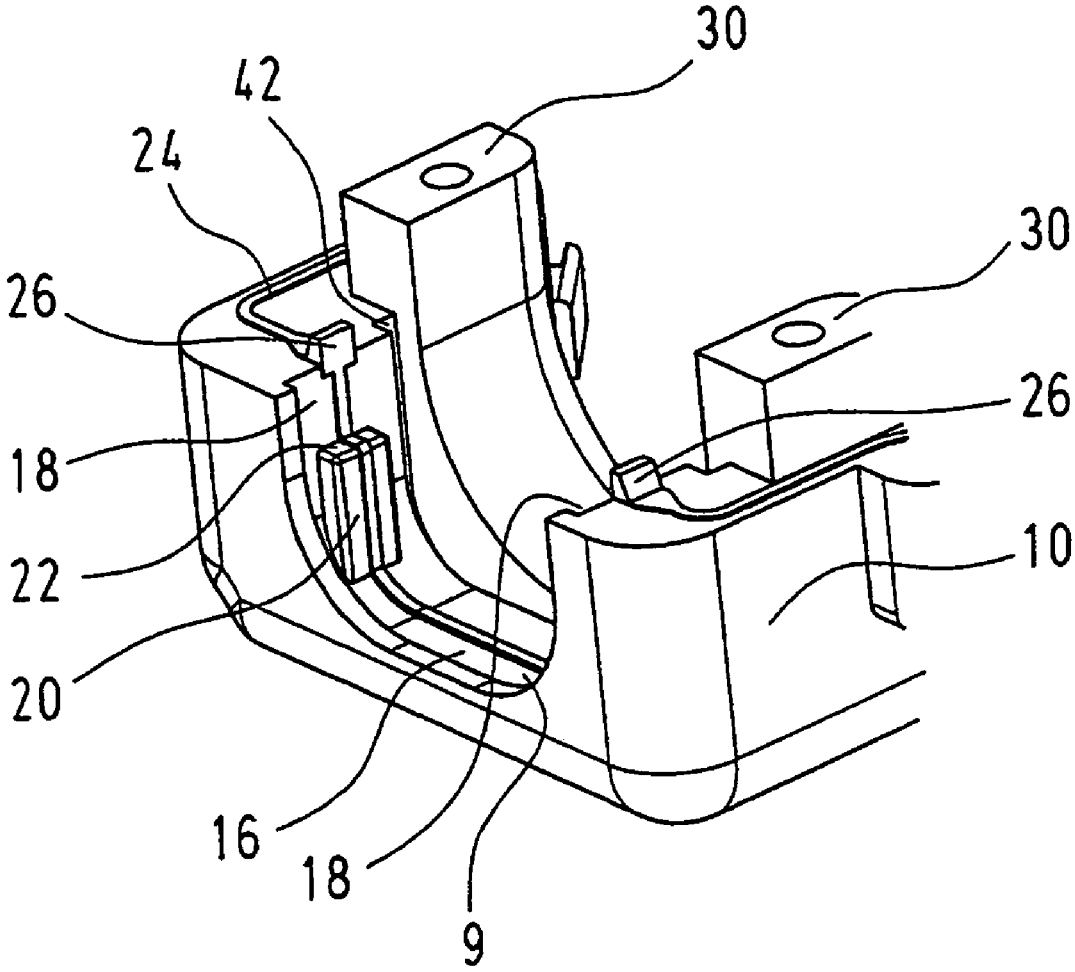
FIG. 4 shows in a perspective view a detail of one housing part.

The cable passage 9 is divided in two parts by the parting line 14, of which the larger part is situated in the first housing part 10 and the smaller part in the second housing part 12. The part of the cable passage 9 located in the first housing part 10 (see in particular FIG. 4) is U-shaped with a base 16 and two side walls 18. Formed on each side wall 18 is a projecting web 20 which at its side facing the parting line 14 is provided with an end wall 22 parallel to the latter; and at its side facing the base 16, the web 20 terminates in the region of the transition from the side walls 18 towards the base 16.

The first housing part 10 is provided with a surrounding seal 24 which extends along the parting line 14 and also through the part of the cable passage 9 located in the first housing part 10. The exposed surface of the seal 24 extends corresponding to the contour of the cable passage 9, i.e. projects towards inside at the webs 20. In the region of the transition of each side wall to the parting line 14, the seal 24 is provided on each side of the cable passage 9 with two prestressing lugs 26 which project beyond the parting line and are skewed on their side facing away from the cable passage 9.

Towards the inside of the plug housing 5, a cable clamp 28 adjoins the cable passage 9; a buttress 30 of the cable clamp is formed in the first housing part 10.

The remaining part of the cable passage 9 is formed in the second housing part 12. Here too, a U-shaped recess is provided which has a base and two side walls. Further, webs 20 are provided in the side walls, just like in the first housing part 10. Provided in the region of the transition of each side wall to the parting line is an obliquely extending, correspondingly recessed pressure face 32 for receiving the prestressing lugs 26.

For sealing in the region of the cable passage 9 there is provided a sealing insert 34 made of rubber. The material of the sealing insert 34 has a hardness which is higher than that of the rubber material of the seal 24. The sealing insert 34 is composed of a sealing portion 36, a clamping portion 38 and an intermediate flange 40. The sealing portion 36 is provided to be arranged in the region of the actual cable passage 9 between the two U-shaped recesses in the two housing parts 10, 12. It has a somewhat square cross-section with rounded corners, just like the cable passage 9. The sealing portion 36 is provided to be arranged in the cable clamp 28. It has a round cross-section. The flange 40 is provided to be received in a flange receptacle 42 in the first and second housing parts 10, 12. It likewise has a square cross-section with rounded corners.

Figure 5:
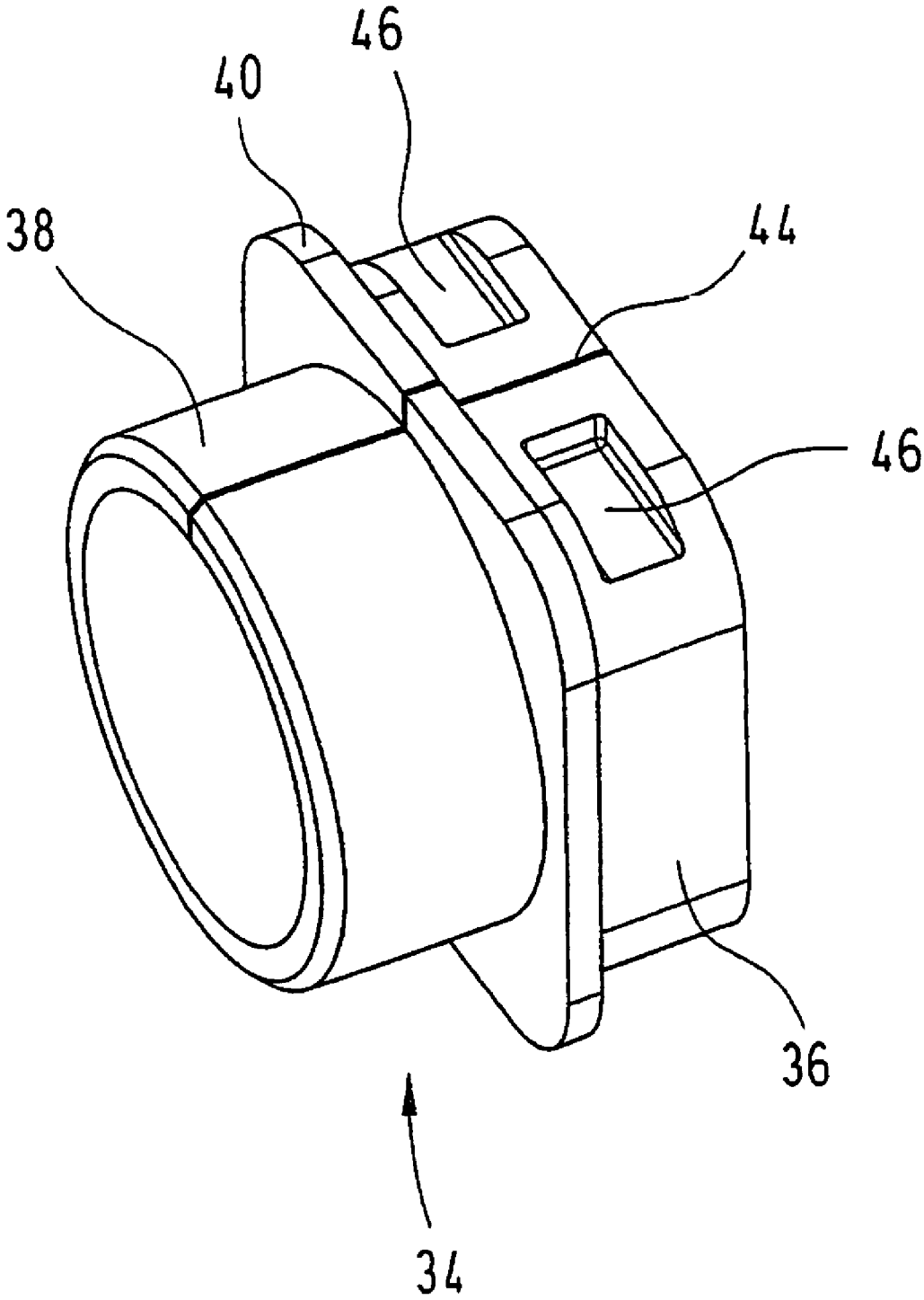
FIG. 5 shows a sealing insert in a perspective, enlarged view.
Figure 6:
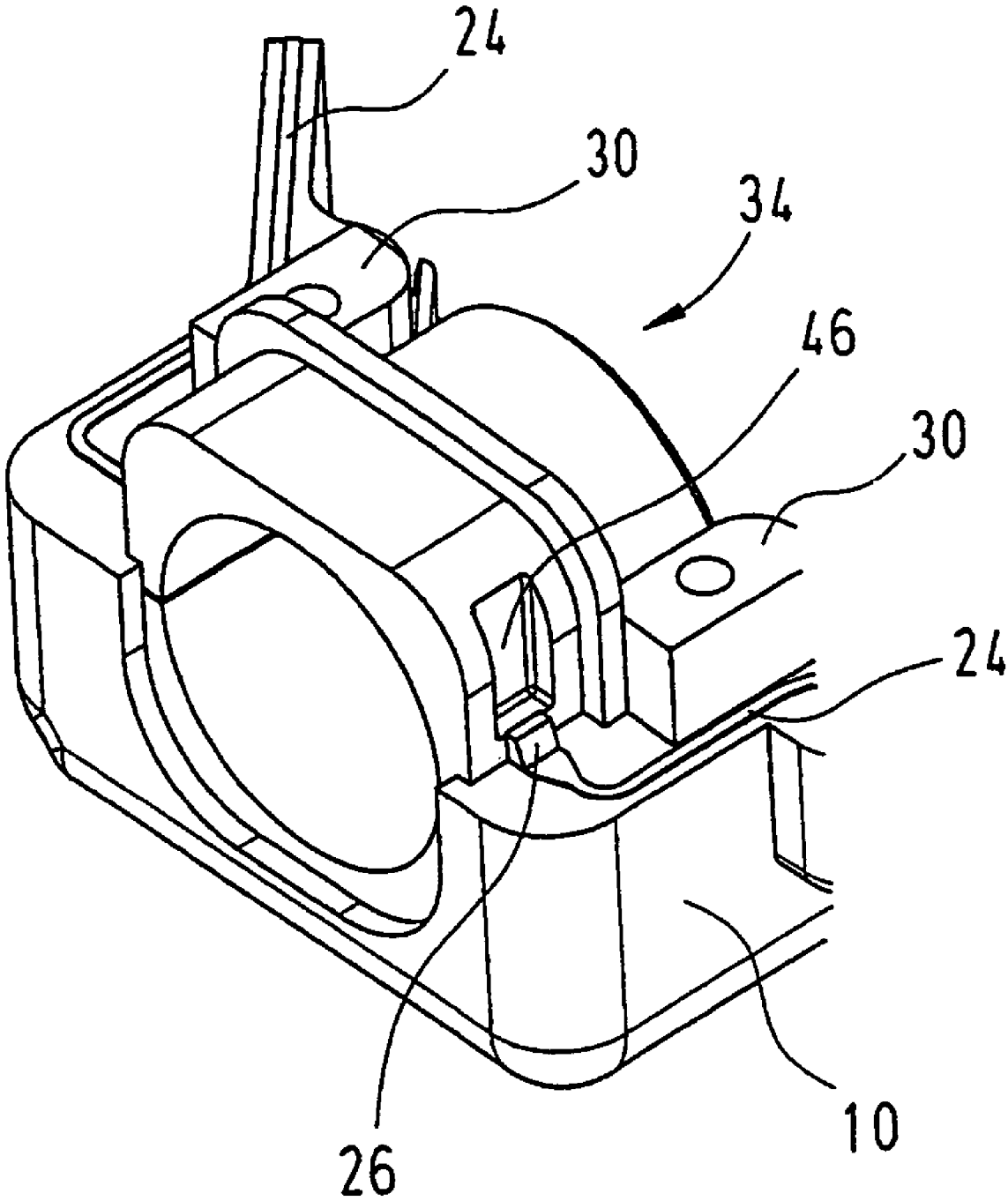
FIG. 6 shows in a perspective view the housing part of FIG. 4 equipped with the sealing insert of FIG. 5.

The sealing insert 34 is provided with a slot 44 that is arranged in the middle of one of the sides of the square sealing portion 36. It is due to the slot 44 that the sealing insert 34 can be attached on the preassembled cable 8. Two grooves 46 are provided on that side of the sealing portion 36 where also the slot 44 is provided; the grooves each start in the region of a rounded corner and terminate at a sufficient distance before the slot 44. In the region of the slot 44 the wall of the sealing portion 36 keeps its usual thickness. The grooves 46 are also arranged at the lower side of the sealing portion 36, which can not be seen in FIG. 5, so that the sealing insert 34 is symmetrical with regard to two planes that are perpendicular to each other. The first one of these planes extends right through the slot 44, and the line of intersection of the two planes is coincident with the central axis of the sealing insert 34 and, hence, also with the central axis of the cable 8.

For mounting the preassembled cable 8 in the plug housing 5, the sealing insert 34 is first placed on the cable 8 by forcing the slot 44 apart to such an extent that the sealing insert 34 can be pushed on the cable 8. Then the insulating body 7 is arranged in the first housing part 10 in an insulating body receptacle 48 associated to it, and the cable 8 is laid into the part of the cable passage 9 which is disposed in the first housing part 10. In so doing, the sealing insert 34 is positioned between the side walls 18 such that the two webs 20 engage into opposite grooves 46 of the sealing portion 36 of the sealing insert 34. The slot 44 is disposed here in the region of one of the side walls 18 (see FIG. 7) because the parting line 14 is offset with respect to the center plane M of the housing and, hence, also to the center of the cable passage 9. This ensures that the sealing insert 34 is correctly prefixed with closed slot 44 in the first housing part 10, despite the slight pressure which is exerted by the cable 8 inserted in it and which seeks to force apart slot 44. Subsequently the cable clamp 28 can be completed by a metal clip 50 being screwed on the buttress 30, such metal clip pressing onto the clamping portion 38 of the sealing insert 34. In this way the cable can be fixed in the housing part 10. If desired, it is also possible to electrically connect a braided shield with the cable clamp 28 consisting of the buttress 30 and the metal clip 50, if the cable 8 is a shielded cable.

Finally the second housing part 12 is placed on the first housing part 10 and is screwed therewith. In so doing, the sealing insert 34 whose dimensions in the initial state are slightly larger than the dimensions of the cable passage 9, is slightly compressed so that it rests at the side walls of the cable passage 9 under pretension. It is due to the pressure applied that the slot 44 of the sealing insert 34 is likewise compressed, so that a good sealing effect will be obtained at this place. The good sealing effect is completed by the surrounding seal 24 which on the one hand seals between the two housing parts and on the other hand, due to the prestressing lugs 26 in combination with the pressure faces 32, in the region of the transition to the sealing insert 34, in particular at the side of the slot 44. In this way a good sealing effect is achieved both between the cable 8 and the sealing insert 34 and as well between the two housing parts 10, 12, and finally also between the sealing insert 34 and the two housing parts 10, 12, so that a type of protection of class IP65 or more can be achieved, which is well suitable for industrial use.

According to a (not shown) further embodiment of the invention, the webs 20 could also be provided on the second housing part 12 in order to act upon the slot 44 with a more defined pretension.

The invention claimed is:

1. A plug housing comprising a first housing part and a second housing part which rest at each other along a parting line, a cable passage for a cable from the interior of said plug housing towards the outside, said parting line extending in a region of said cable passage, and a sealing insert arranged in said cable passage, said sealing insert having a C shaped cross-section, said sealing insert being provided with a single slot which extends completely through a wall of the sealing insert so that the sealing insert can be placed on a preassembled cable, and said sealing insert being arranged such that said slot has an offset with respect to said parting line.

2. The plug housing according to claim 1, wherein said parting line is offset with regard to a center plane of said housing by less than 10% of a thickness of said housing.

3. The plug housing according to claim 1, wherein said cable passage, as measured in a direction perpendicular to said parting line, is slightly smaller than the width of said sealing insert.

4. The plug housing according to claim 1, wherein said slot extends parallel to said parting line.

5. The plug housing according to claim 1, wherein said first housing part is provided with a surrounding seal.

6. The plug housing according to claim 5, wherein said seal extends through a part of said cable passage which is situated in said first housing part.

7. The plug housing according to claim 5, wherein said seal is provided with two skewed prestressing lugs which are arranged so as to lie opposite in a region of said cable passage and protrude beyond said parting line.

8. The plug housing according to claim 7, wherein said second housing part is provided with two obliquely arranged pressure faces through which said prestressing lugs of said seal are pressed against said sealing insert.

9. The plug housing according to claim 5, wherein a material of said seal has a hardness which is different from the hardness of the material of said sealing insert.

10. The plug housing according to claim 9, wherein a material of said seal has a lower hardness than a material of said sealing insert.

11. The plug housing according to claim 1, wherein said sealing insert has an outer surface which is provided with at least two grooves, one of said grooves being arranged on one side of said slot and the other being arranged on the other side of said slot.

12. The plug housing according to claim 11, wherein at least one of said housing parts is provided with a web that engages said groove.

13. The plug housing according to claim 12, wherein said web is assigned to said first housing part that has a larger thickness than said second housing part.

14. The plug housing according to claim 12, wherein said parting line is disposed approximately in the middle between said slot of said sealing insert and an end of said groove.

15. The plug housing according to claim 1, wherein said cable passage has a square cross-section with rounded corners.

16. The plug housing according to claim 15, wherein said sealing insert, apart from said slot, is symmetrical with respect to two planes that are perpendicular to each other, whose line of intersection is coincident with a central axis of said cable passage and of which one extends through said slot.

17. The plug housing according to claim 1, wherein one of said housing parts is provided with a cable clamp and said sealing insert is provided with a clamping portion which can be clamped within said cable clamp.

18. The plug housing according to claim 17 wherein said cable clamp is adapted to a clamp braided shield of said cable.

* * * * *

UNITED STATES PATENT AND TRADEMARK OFFICE

CERTIFICATE OF CORRECTION

PATENT NO. : 7,040,916 B2
APPLICATION NO. : 10/963364
DATED : May 9, 2006
INVENTOR(S) : Schmidt et al.

It is certified that error appears in the above-identified patent and that said Letters Patent is hereby corrected as shown below:

The sheets of drawings consisting of figures 1-2 should be deleted to appear as per attached figures 1-2.

Signed and Sealed this

Thirteenth Day of November, 2007

JON W. DUDAS
*Director of the United States Patent and Trademark Office*